US006831559B2

(12) United States Patent
Chen

(10) Patent No.: US 6,831,559 B2
(45) Date of Patent: Dec. 14, 2004

(54) SECURITY ALARM WITH REMOTE TRIGGERING DEVICE

(75) Inventor: Han-Liang Chen, Taipei (TW)

(73) Assignee: Motedo Co., Ltd., Taipei (TW)

( * ) Notice: Subject to any disclaimer, the term of this patent is extended or adjusted under 35 U.S.C. 154(b) by 0 days.

(21) Appl. No.: 10/370,731

(22) Filed: Feb. 24, 2003

(65) Prior Publication Data

US 2004/0164862 A1 Aug. 26, 2004

(51) Int. Cl.[7] ..... G08B 13/08

(52) U.S. Cl. ..... 340/545.7; 340/545.2; 340/545.6; 340/546; 340/570

(58) Field of Search ..... 340/540.1, 546, 340/545.2, 548, 545.6, 545.7, 545.8, 568.1, 569, 570

(56) References Cited

U.S. PATENT DOCUMENTS 4,225,857 A * 9/1980 Frank ..... 340/546
4,688,023 A * 8/1987 McGill et al. ..... 340/545.6
5,097,253 A * 3/1992 Eschbach et al. ..... 340/545.1

* cited by examiner

*Primary Examiner*—Benjamin C. Lee
(74) *Attorney, Agent, or Firm*—Birch, Stewart, Kolasch & Birch, LLP

(57) ABSTRACT

A security alarm with a wired remote triggering device consists of a triggering switch with two spring blades and a flexible sleeve tube holding both spring blades together. The security alarm with a strap is hung on the doorknob inside a door or placed inside a drawer, and the triggering device is set up from outside of the door or the drawer by pulling off the flexible sleeve tube. The two spring blades will thus be clipped in a gap between the door and its frame to keep the alarm circuitry open. When any unauthorized person opens the door or the drawer, the triggering device will fall off from the gap; thus the two spring blades will automatically open to keep the alarm circuitry in close status so as to activate the alarm, so the theft deterrent purpose is consequently achieve.

8 Claims, 14 Drawing Sheets

SECURITY ALARM WITH REMOTE TRIGGERING DEVICE

BACKGROUND OF THE INVENTION

1. Field of the Invention

The present invention relates to a security alarm with a wired remote triggering device with a flexible tube sleeve, more particularly, a security alarm configured inside the door or the drawer can be set up from outside of the door or the drawer.

2. Description of the Related Art

The crime rate escalates rapidly in accordance with the improved living standards, and civilians currently are unable to fully count on the law enforcement to protect their lives and property, thus security alarms and systems become popular products in the market. There are various door alarms in the market, but they still have some problems with their performances and functions.

Refer to FIG. 11 and FIG. 12 for the conventional security alarm with wired remote triggering device. The alarm is hung on a doorknob (b) inside a door, and the two spring blades (a11, a12) of the triggering device (a1) are first clipped together with our fingers to keep the alarm circuit in "open" status, then two spring blades (a11, a12) are carefully inserted in the gap (e) between the door (c) and its frame (d) to set up the alarm (a) from inside of the door. When any unauthorized person opens the door, the triggering device (a1) will subsequently fall off, and the two spring blades (a11, a12) will spring open to trigger the alarm.

Said security alarm can only be set up from inside of the door, and the problem appears when the user is leaving the perimeter and wishes to set the alarm from outside of the door to arm the perimeter against any intruder.

Refer to FIG. 13 for the static sensor security alarm (f). An external conductive wire loop (f1) is hung on the metal doorknob (b1, b2) as the sensor detecting the change of the static charges when said alarm is in armed condition. Since both metal doorknobs (b1, b2) are electrically connected by metal parts of the door lock, the static charges will change when any metal part of the door lock is in contact with any conductive object, e.g., a human hand. When the security alarm (f) detects the potential deference from the doorknob (b1) through the conductive wire loop (f1), the alarm (f) will be triggered instantly.

The detecting sensitivity of said alarm is often affected by the following factors:

1. Ambient temperature and humidity: Since the temperature and humidity will easily change the electric charges stored in the door lock; thus the potential difference of the doorknobs (b1, b2) is not stable. In other words, the detecting accuracy of said alarm (f) is affected by the ambient temperature and humidity.

2. Material of the door lock and doorknobs (b1, b2): Material composition of the lock and doorknobs (b1, b2) determines the electric conductivity of the metal parts, and the coating material on the doorknob sometimes might be an insulating material.

In view of the description above, the detecting sensitivity of said security alarm (f) is affected by those factors. Said security alarm (f) thus includes the function of sensitivity adjustment to deal with aforesaid problems, but false alarm or malfunction still frequently exist due to user's failure to optimize the sensitivity; thus such function is apparently not a user-friendly design.

In FIG. 14, it shows a security alarm (g) with the magnetic switch. The embodiment shown in the diagram consists of a magnet (g1) fixed to the frame (d) and an alarm device (g2) fixed to the door (c) near the magnetic field of the magnet (g1). When said security alarm is armed with the door (c) closed, the magnet (g1) will hold the magnetic switch inside the alarm device (g2) to keep the alarm circuit in "open" status. When the door (c) is opened, the alarm device (g2) will be moved away from the magnet (g1), and the alarm circuit will be switched to "close" status and thus trigger the alarm.

Installation of said security alarm is easy, but flaws and problems still exists as follows:

1. It has an inharmonic look on the surface of the door or window in some users' eyes. As the double-sided adhesive tape is often used for installation, and the adhesive residue will remain on the door or window when the security alarm is removed, thus removing the adhesive residue becomes necessary and laborious. Moreover, the double-sided adhesive tape may automatically peel off after a period of time, which may accidentally cause the alarm to be triggered or disarmed.

2. The sensitivity of magnetic switch will be affected by the gap between the alarm device (g2) and the magnet (g1), and if said gap is enlarged, the normal operation of the security alarm will thus be affected.

3. The magnet (g1) may be degaussed after a period of time, which may cause the false alarm or malfunction of the security alarm (g).

In view of the descriptions above, the existing security alarms for doors or windows still have functional problems or flaws pending review and improvement.

SUMMARY OF THE INVENTION

The primary objective of this invention is to provide a security alarm with an extra function, which can be set up from outside of the door (or the drawer) by implementing a flexible sleeve tube while the conventional security alarm can only be set up from inside of the door.

To achieve the aforesaid function, the main concept of this invention is to implement the flexible sleeve tube to hold together the two spring blades of the wired triggering device to keep the alarm circuit in "open" status; wherein:

The spring blades are connected to the same lead of the wire in the triggering device as shown in FIG. 4. The alarm circuit will be switched to "closed" status to trigger the alarm when two spring blades sprang open, and the alarm circuit will be kept in "open" status if the two spring blades are held together by the flexible sleeve tube.

As the two spring blades are very thin and flexible, they can be inserted into the tiny gap between the door and doorframe without any problem of shutting the door. When any unauthorized person opens the door or the window, the wired triggering device will fall off and the two spring blades will spring open to trigger the alarm instantly. Said alarm of prior art can only be configured from inside of the door.

Besides the aforesaid functions, the present invention implements a flexible sleeve tube of a proper length to hold the two spring blades together in the gap between the door and doorframe or the desk and drawer, and the flexible sleeve tube can be pulled off from outside of the door or drawer to set up the security alarm after the door or drawer is closed.

Said alarm configuration can be applied to door, drawer or window easily with wired remote triggering device and the flexible sleeve tube to prevent unintended triggering of the alarm; moreover the present invention provides the function to set up the security alarm from outside of the door or drawer, which surpass its prior art by a very simple structure.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other features and advantages of the present invention are detailed in the following preferred embodiments with reference to the accompanying drawings which are given by way of illustration only, and thus are not limitative of the present invention, and wherein.

DETAILED DESCRIPTION OF THE PREFERRED EMBODIMENT

Figure 1:
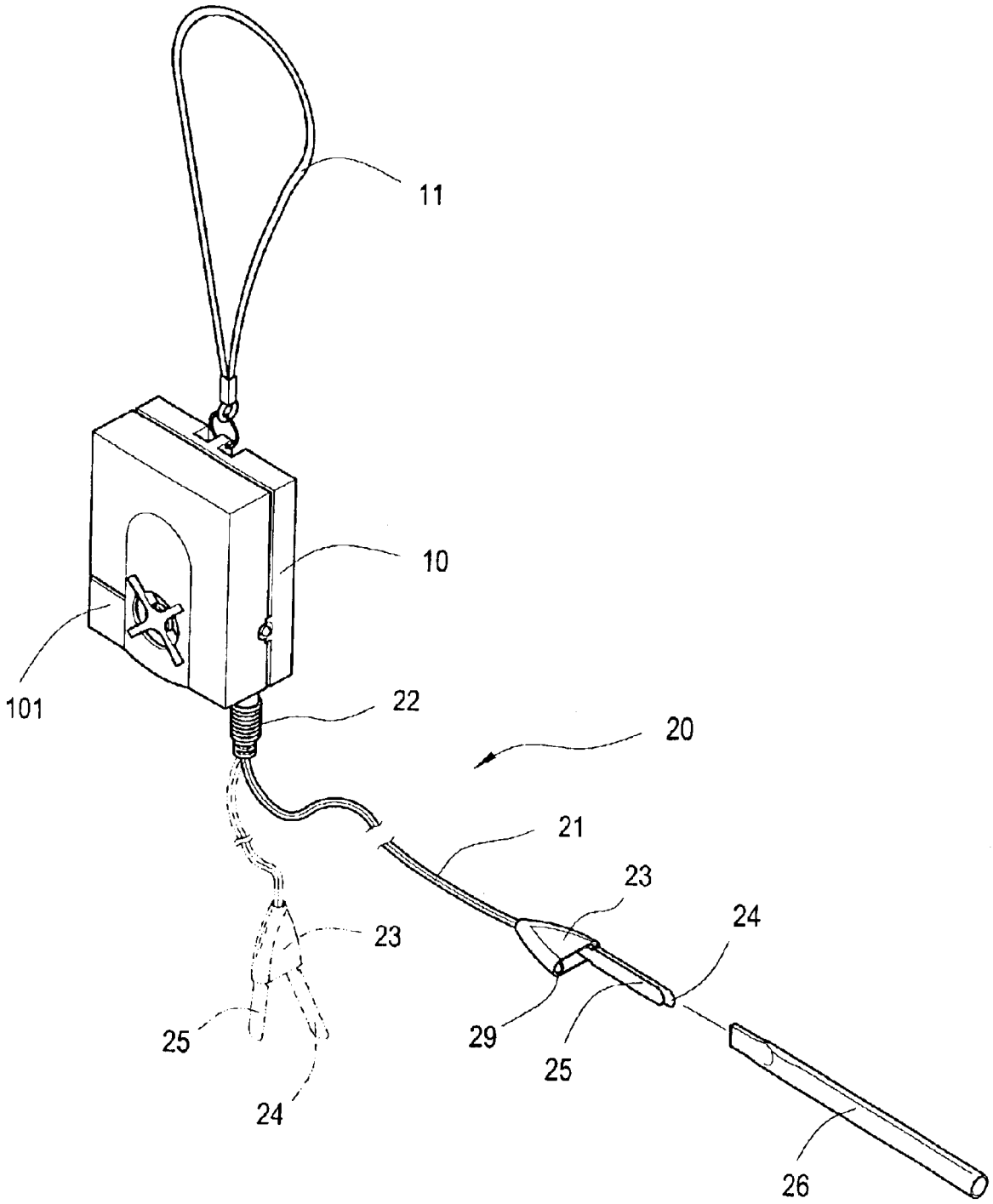
FIG. 1 is a perspective diagram of the present invention.

To make it easier for the examiner to understand the objective of the present invention, its structure, innovative features and performance, we describe the preferred embodiment along with the drawings for detailed description of the invention. In the detailed description of the preferred embodiment, elements are indicated by the same reference numerals through out the disclosure.

Refer to FIG. 1 for the structure of the present invention, which comprises a security alarm device 10 and a wired remote triggering device 20, and the functional relation between the devices is described as follows:

The security alarm device 10 comprises an alarm circuitry inside, which can be activated or deactivated by a wired remote triggering device. (The alarm circuitry is an know art and not a part of the present invention; thus not described herein.) The security alarm can also incorporate a strobe light 101 to have the dual functions of portable alarm and lighting device.

Figure 2:
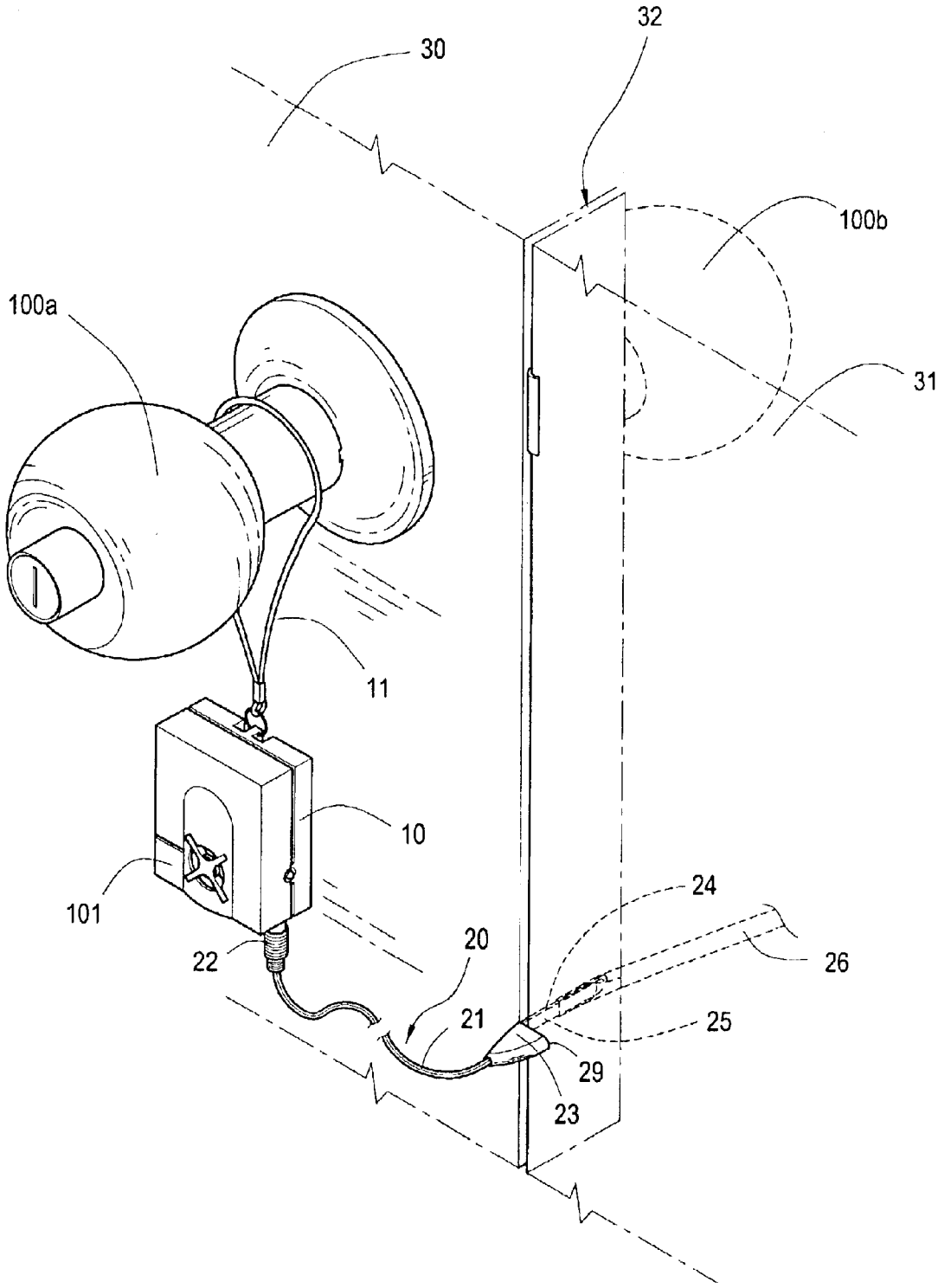
FIG. 2 is a perspective diagram of the wired remote triggering device being inserted into the gap between the door and doorframe of the present invention.
Figure 3:
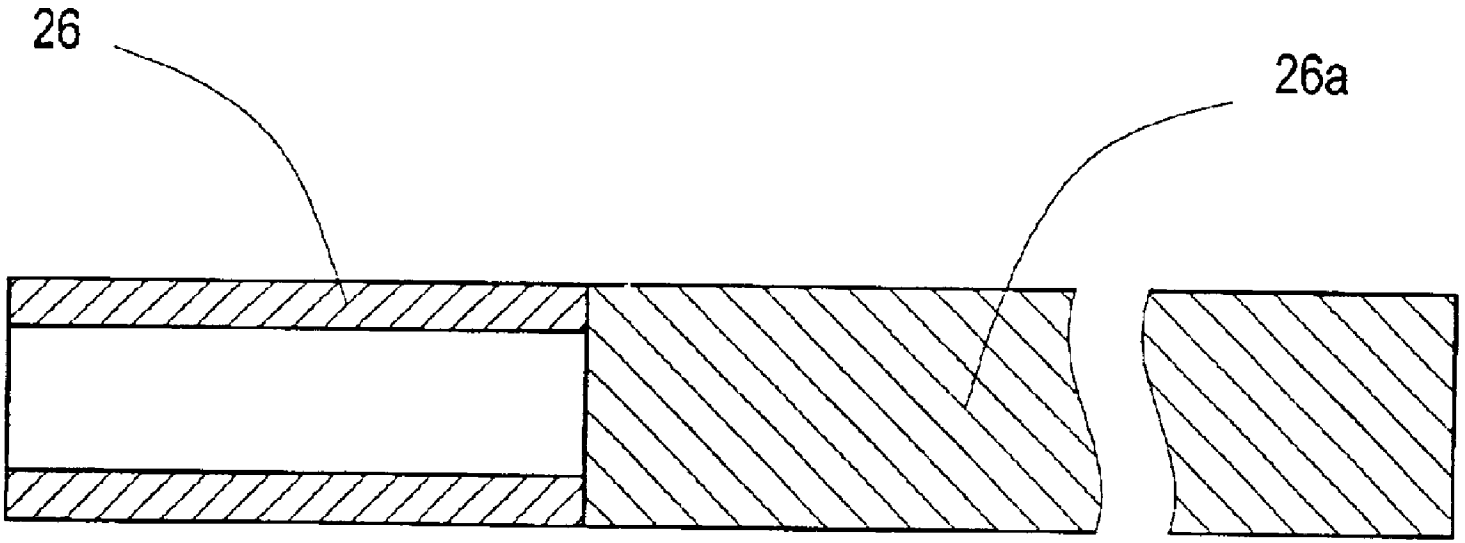
FIG. 3 is a cross-sectional diagram of the flexible sleeve tube of the present invention.
Figure 4:
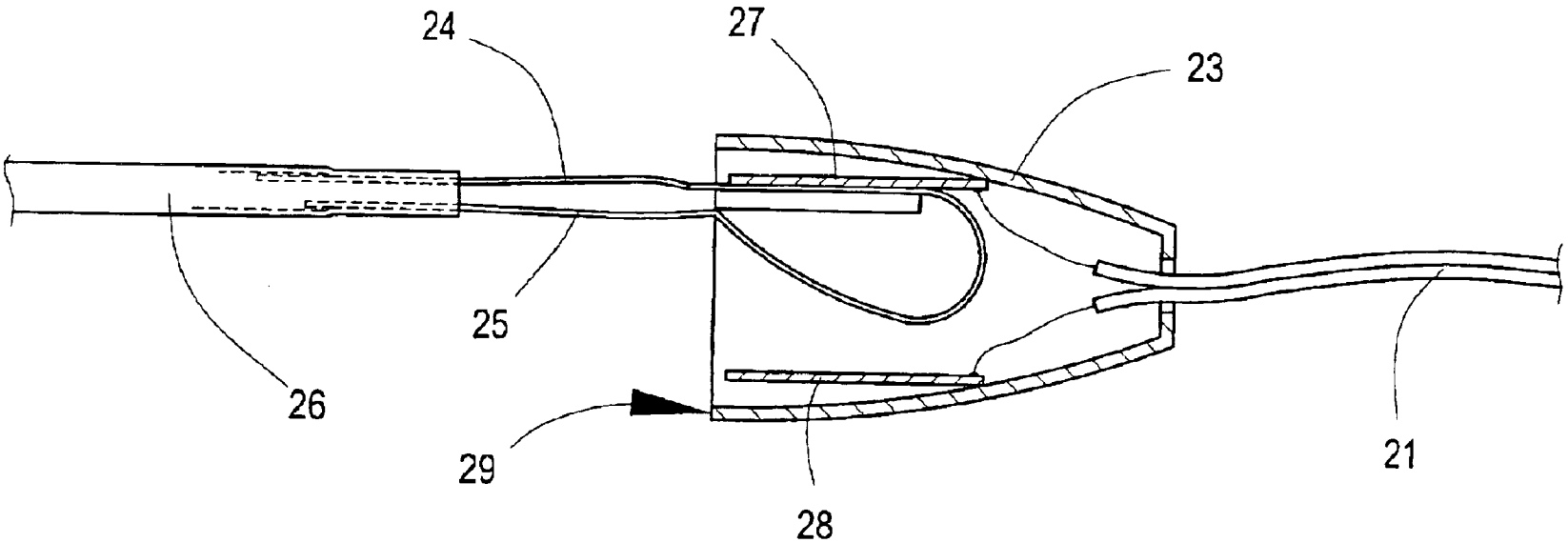
FIG. 4 is a cross-sectional diagram of the wired remote triggering device of the present invention with the alarm circuit open.
Figure 5:
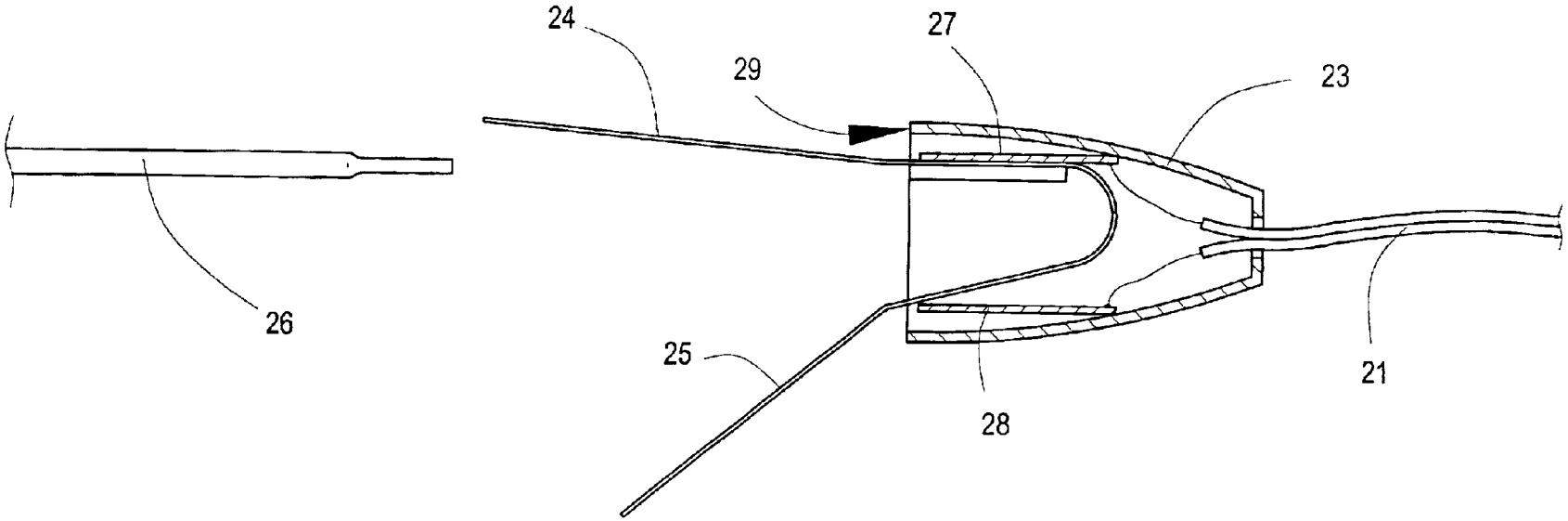
FIG. 5 is a cross-sectional diagram of the wired remote triggering device of the present invention with the alarm circuit closed.

The wired remote triggering device 20 is fixed to the security alarm 10 by wire or detachable from the security alarm 10, and it is to control the activation or deactivation of the alarm circuitry, wherein, in the preferred embodiment, the wired remote triggering device 20 has a plug 22 on one terminal of a wire 21 for connecting same to the security alarm and one triggering switch 23 comprising two spring blades 24, 25 on the other terminal of the wire 21. The two spring blades 24, 25 are held together by a flexible sleeve tube 26 of a proper length as shown in FIG. 2 and FIG. 4; said flexible sleeve tube 26 is made of PVC or other polymer resins, and said flexible sleeve tube 26 can be attached to a proper grip 26*a* shown in FIG. 3 for user to pull easily. Refer to FIG. 4 and FIG. 5, one terminal of the wire 21 is connected to the security alarm 10 and the other terminal of the wire 21 is connected to and the 2 electrodes 27, 28 inside the triggering switch 23, wherein the spring blade 24 is connected to electrode 27, so the spring blade 25 between electrode 27 and electrode 28 becomes a remote switch for the security alarm 10. In the wired remote triggering device 20, when the spring blades 24, 25 are released, the circuitry of the wired remote triggering device 20 will be in "closed" status, which will trigger the alarm circuitry of the security alarm 10, but when the spring blades 24, 25 are held together, the circuitry of the wired remote triggering device 20 will be in "open" status, which will not trigger the alarm circuitry of the security alarm.

To be more specific with the circuitry of the wired remote triggering device 20, the structure of this device is described as follows:

Two copper electrodes 27, 28 are installed inside the triggering switch 23 and connected respectively to the positive and negative end of the wire 21. The spring blades 24, 25 are either connected at one common end or made of one piece of the spring blade, and the spring blade 24 is normally connected to the copper electrode 27. When both spring blades 24, 25 are held together and inserted into the flexible sleeve tube 26, the circuitry between spring blade 25 and copper electrode 28 will be kept in "open" status. When the flexible sleeve tube is pulled off, the spring blades 24, 25 are released to keep two copper electrodes 27, 28 in "closed" status to activate the security alarm 10.

Figure 6:
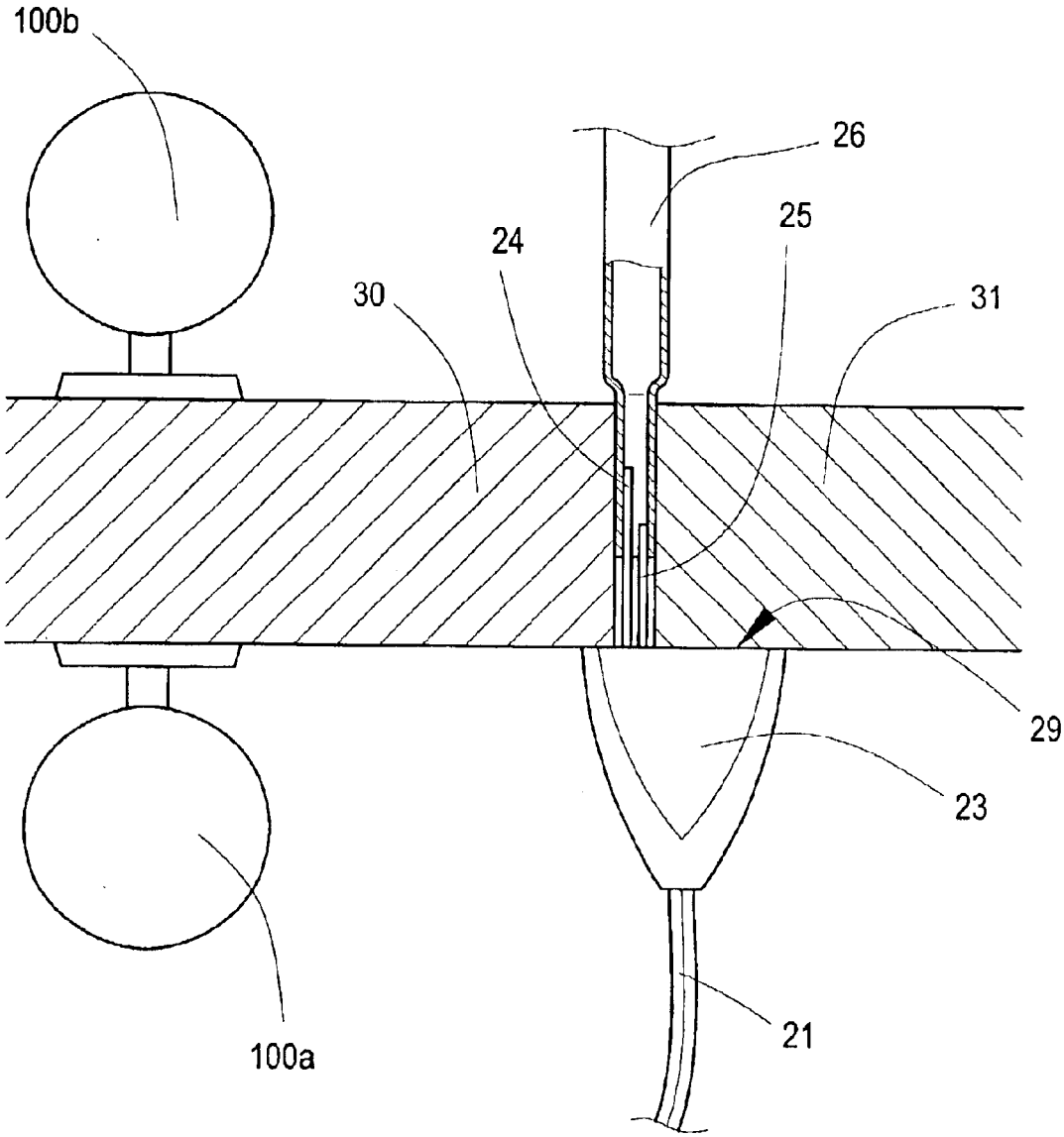
FIG. 6 is a cross-sectional diagram of the wired remote triggering device and the flexible sleeve tube of the present invention inserted in the gap between the door and doorframe.
Figure 7:
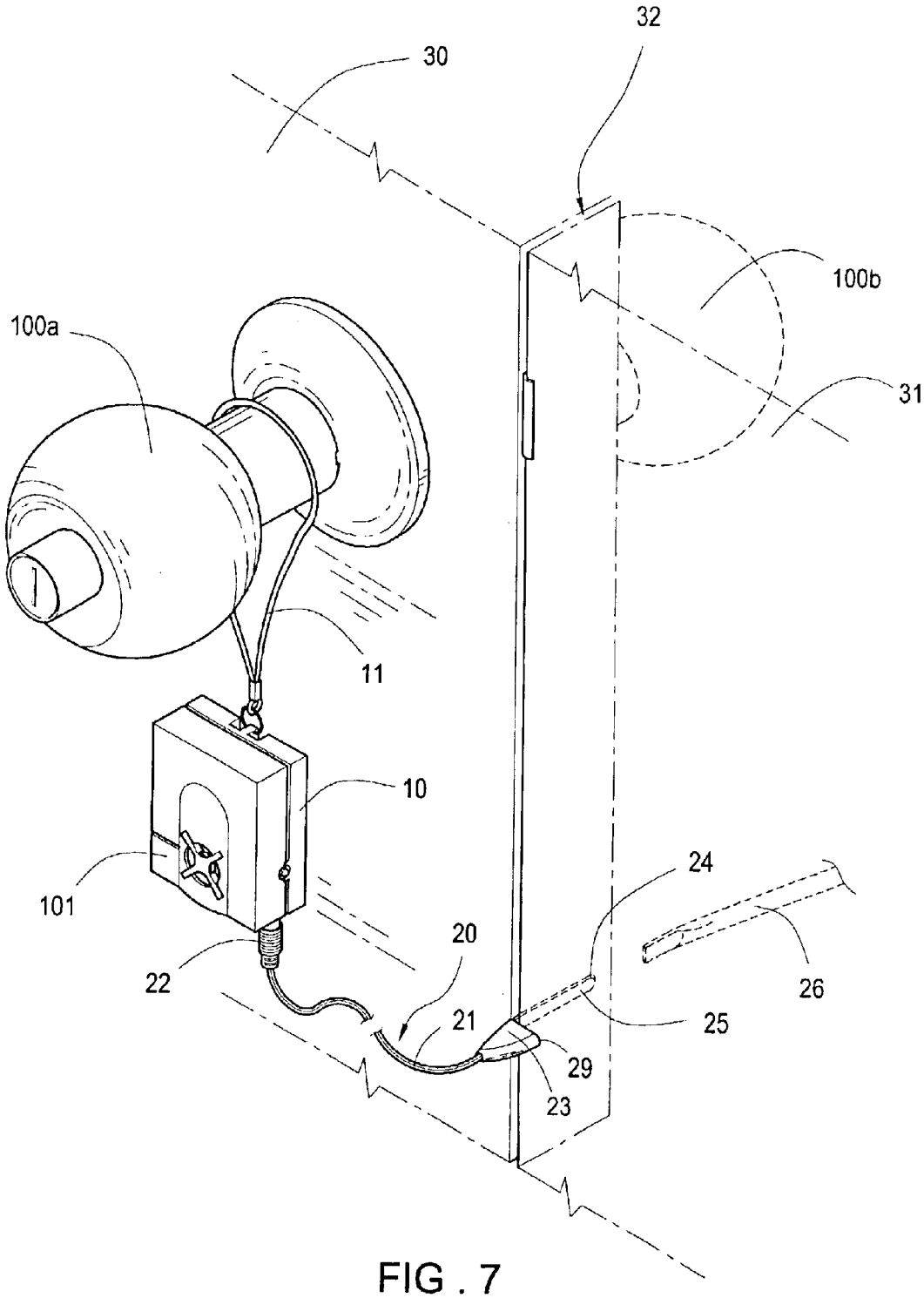
FIG. 7 is a perspective diagram of the wired remote triggering device being inserted into the gap between the door and doorframe with the flexible sleeve tube pulled off according to the present invention.

The primary feature of the present invention is to set up the alarm from outside of the door or drawer by implement the wired remote triggering device 20. Refer to FIG. 2 for the preferred embodiment on a door, wherein, the security alarm 10 is first hung on the inside doorknob 100*a* with a strap 11, then use the flexible sleeve tube 26 to hold the two spring blades 24, 25. The user can use one hand to hold the rear end of the flexible sleeve tube 26 and put it aside the edge of the door, then carefully guide it into the gap 32 between the door 30 and doorframe 31 and assure the edge 29 of the triggering device is immediately behind the door; meanwhile the user can use the other hand to hold the doorknob 100*b* to shut the door, so the two spring blades 24, 25 and the flexible sleeve tube 26 are clipped in the gap 32 between the door 30 and doorframe 31 (as shown in FIG. 6).

Figure 8:
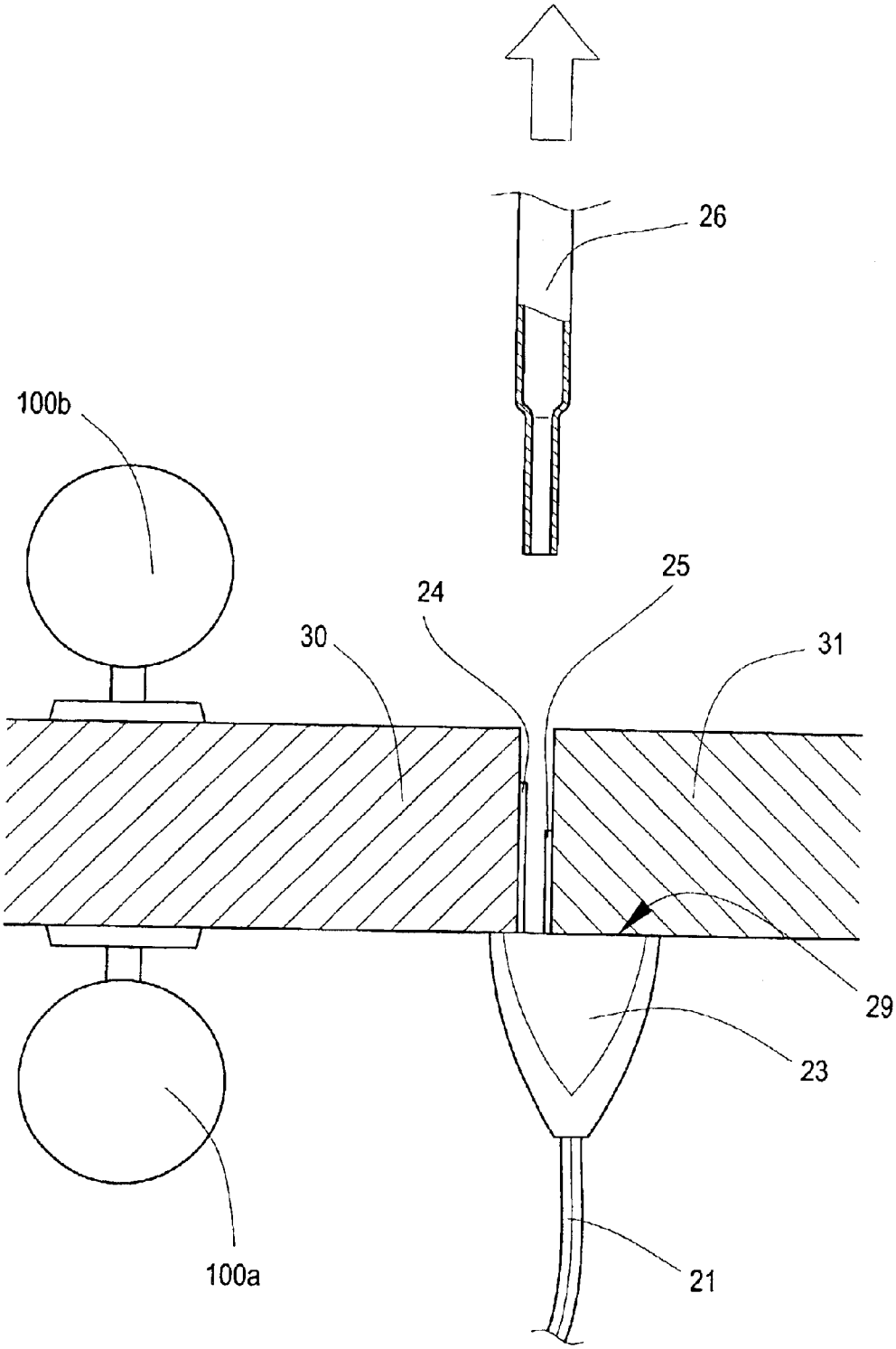
FIG. 8 is a cross-sectional diagram of the wired remote triggering device being inserted into the gap between the door and doorframe with the flexible sleeve tube pulled off according to the present invention.
Figure 9:
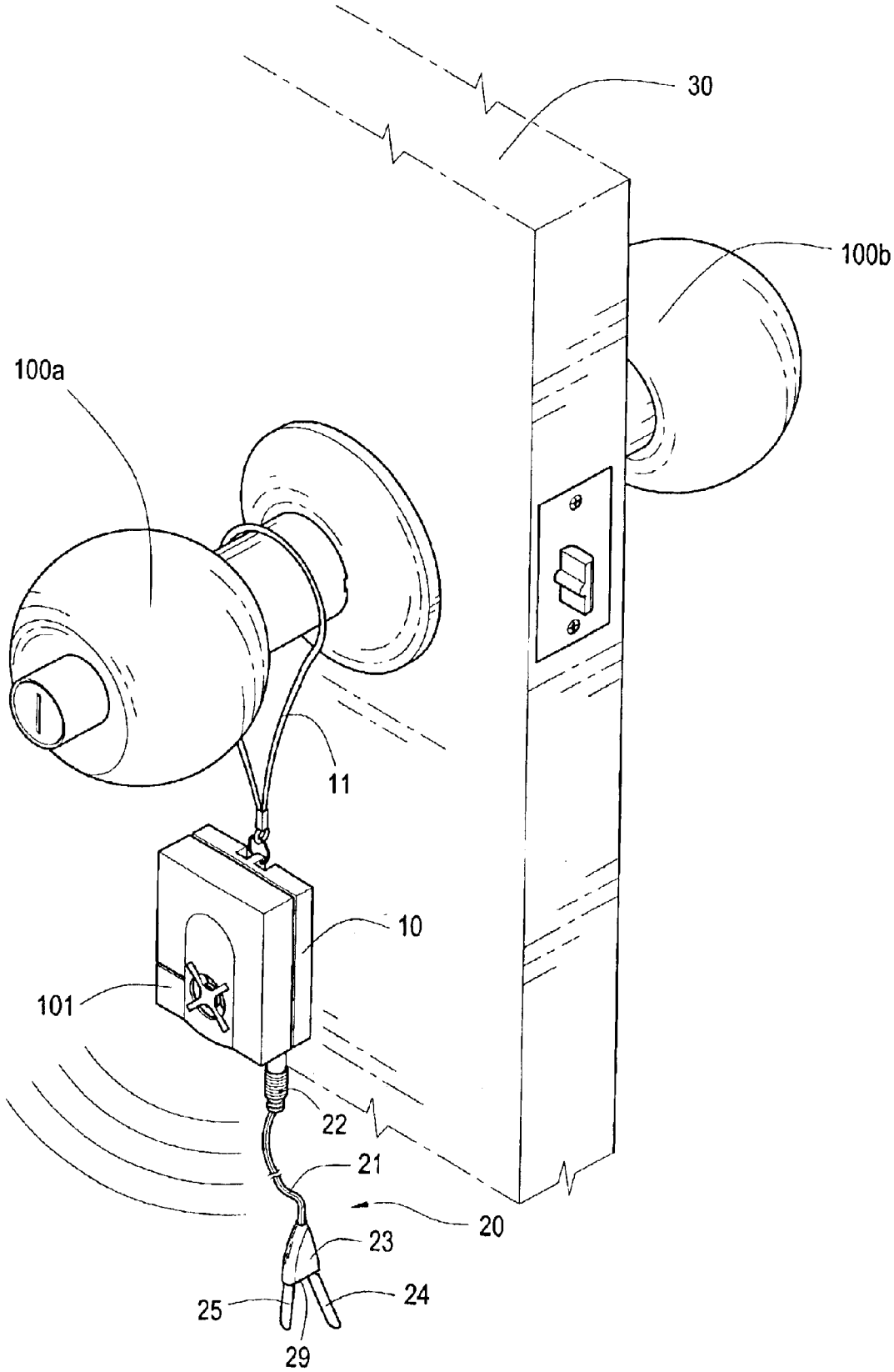
FIG. 9 is an illustrative diagram of the wired remote triggering device fallen off from the gap between the door and doorframe triggering the alarm according to the present invention.

Because the edge 29 of the triggering device is left behind the door 30 against the gap 32, the flexible sleeve tube 26 can be easily pulled off from the gap 32 (as shown in FIG. 8). The set up of the security alarm is completed from outside of the door, and if the door 30 is opened (as shown in FIG. 9) after the set up, the two spring blades 24, 25 will be released and activate the alarm.

Figure 10:
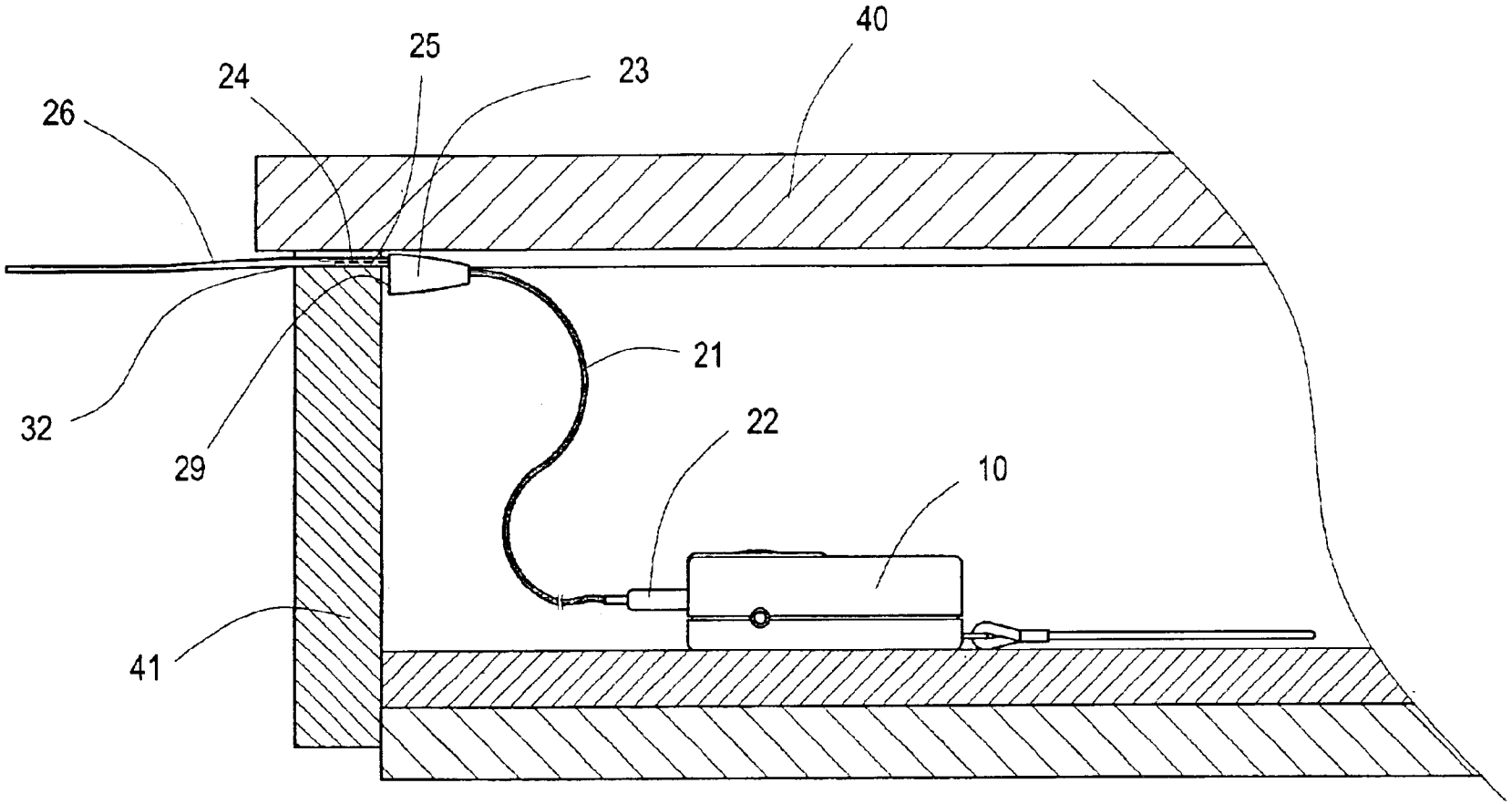
FIG. 10 is a diagram of another preferred embodiment of the present invention.
Figure 11:
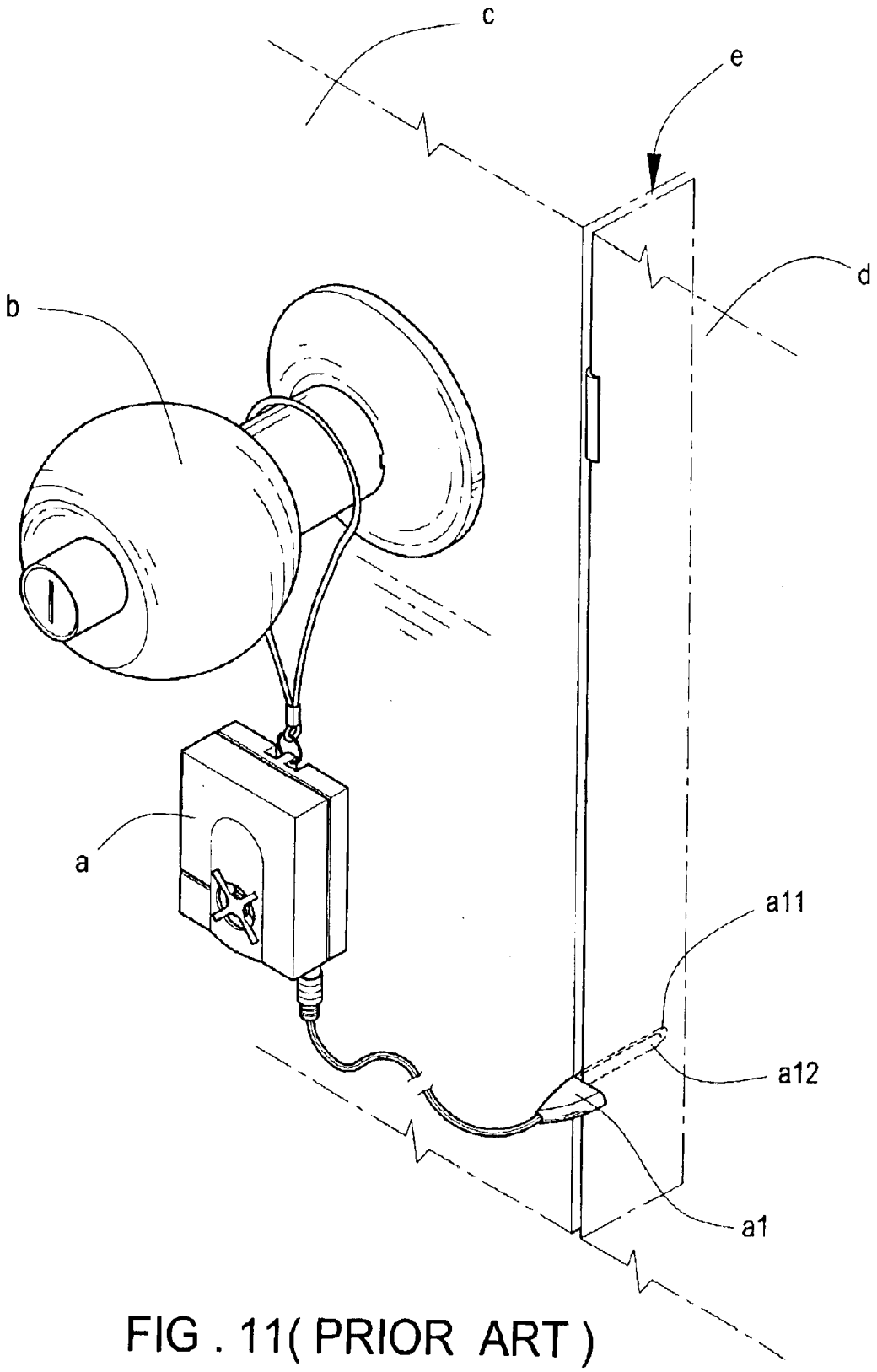
FIG . 11( PRIOR ART )
FIG. 11 is a perspective diagram of a structure of the first prior art in use.
Figure 12:
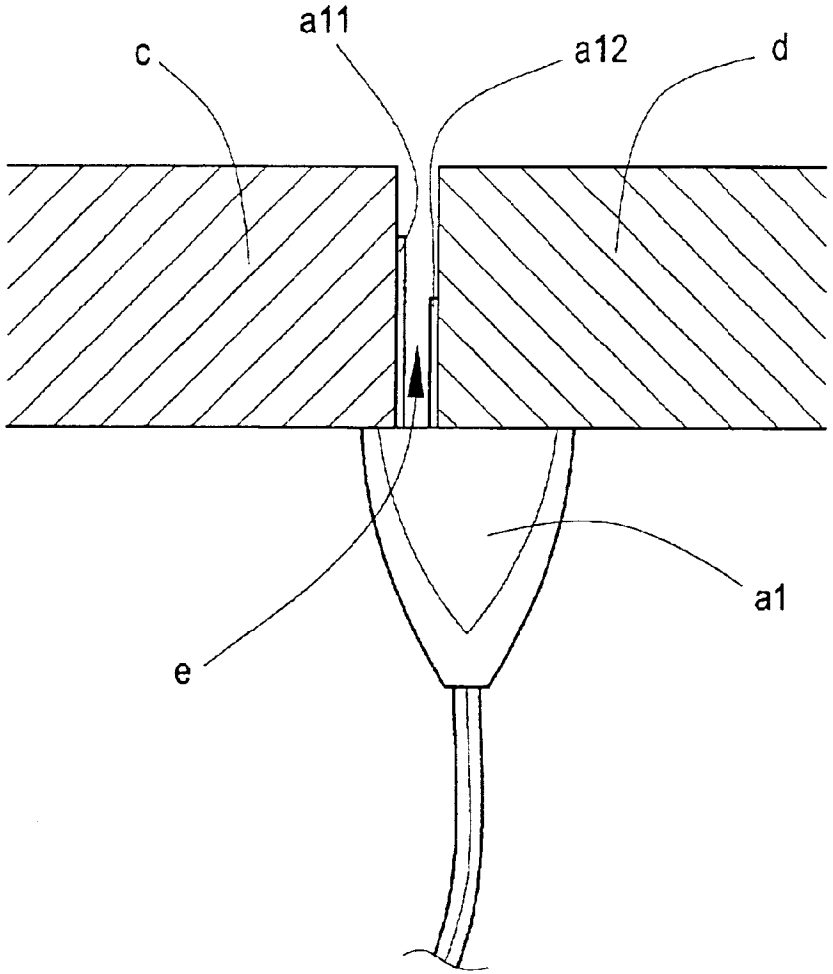
FIG. 12 ( PRIOR ART )
FIG. 12 is a cross-sectional diagram of a structure of the first prior art in use.
Figure 13:
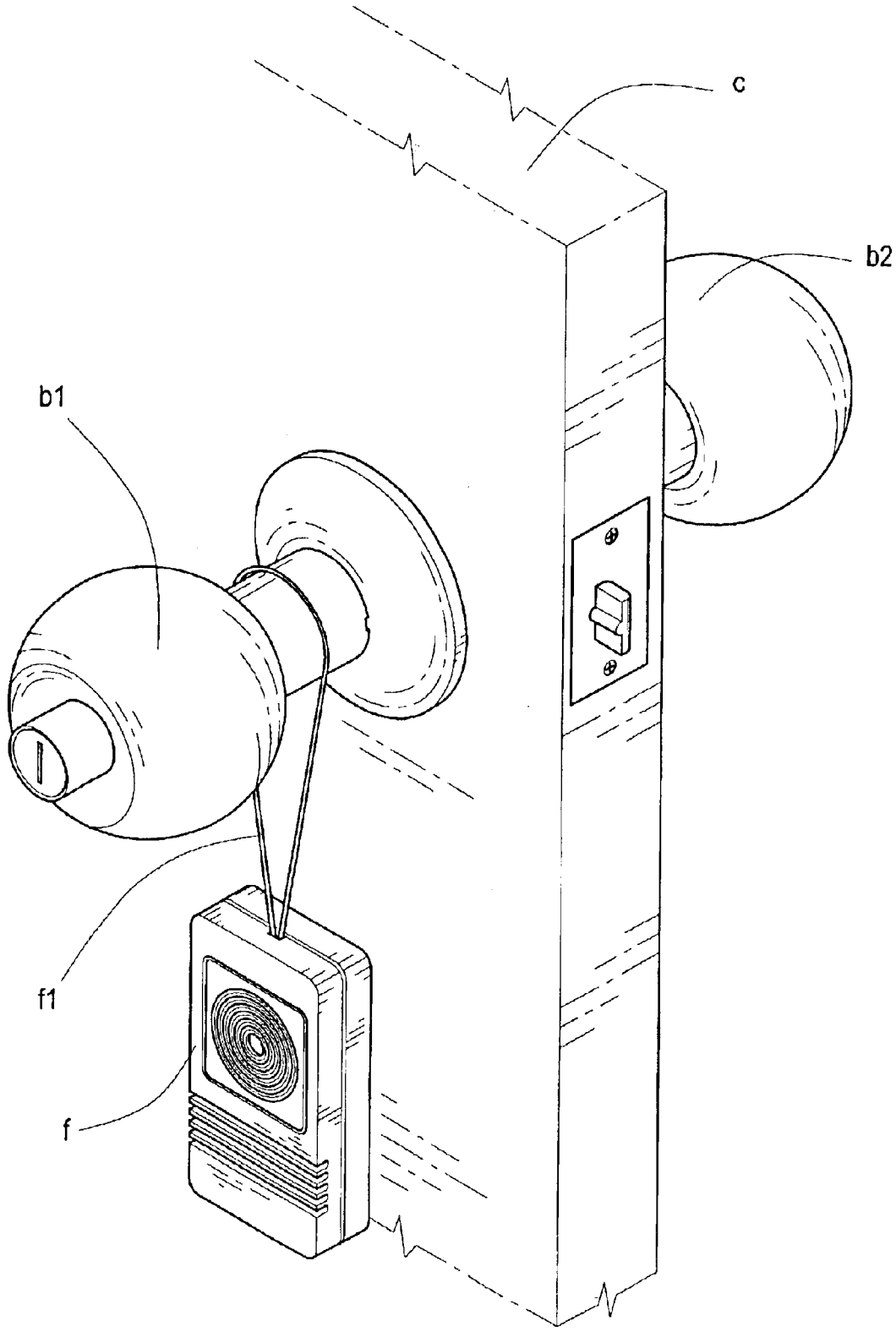
FIG . 13 ( PRIOR ART )
FIG. 13 is a perspective diagram of a structure of the second prior art in use.
Figure 14:
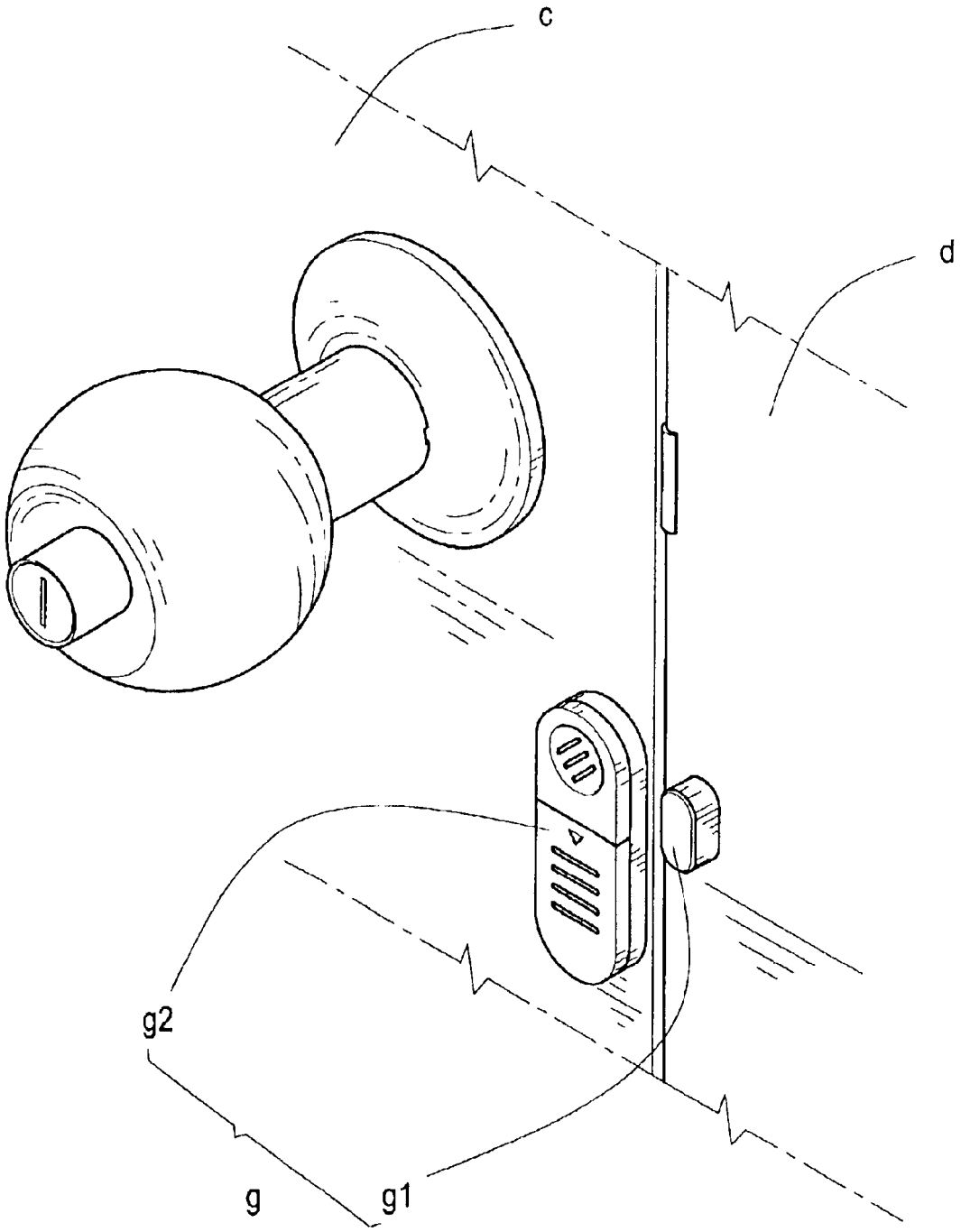
FIG . 14 ( PRIOR ART )
FIG. 14 is a perspective diagram of a structure of the third prior art in use.

The same configuration can be applied to the desk and drawer storing valuables or important office documents (as shown in FIG. 10). The security alarm 10 is first placed in the drawer 41 of the desk 40, then manipulate the wired remote triggering device 20 along with the two spring blades 24, 25 and the flexible sleeve tube 26 in a similar manner described above. When the two spring blades 24, 25 and the flexible sleeve tube 26 are well clipped in the gap 32 between the desk 40 and the drawer 41 when the drawer 41 is closed, pull off the flexible sleeve tube 26 from the gap 32 to set up the security alarm from outside of the drawer 41.

The structure and operation of the present invention are described as above. In the design of the present invention, the two spring blades and the flexible sleeve tube are very thin, so they can be clipped in the gap between the door and doorframe or the desk and drawer without any problem of closing the door or drawer normally or any inconvenience of pulling off the flexible sleeve tube. In other words, the present invention preserves the functions of conventional security alarm with new improvement. If the time delay switch is integrated into the security alarm, the user can turn off the security alarm in a timely manner after the door is opened, and such function is to avoid embarrassing disturbance to the neighbors and thus increase the convenience and advantage of the security alarm. The present invention is to implement a simple tool to increase the functional flexibility and improve the inconvenience of the prior art without modifying the structure of the security alarm or any significant cost. The following analysis for different security alarms is provided for the examiner's reference.

| SECURITY ALARMS | FEATURES | | | | |
|---|---|---|---|---|---|
| | SET UP FROM OUTSIDE OF THE DOOR | FOR THE SECURITY OF DESK DRAWER | SET UP FROM INSIDE OF THE DOOR | RATE OF FALSE ALARM | DISHARMONIZING LOOK |
| The Present Invention | Yes | Yes | Yes | Low | No |
| Conventional Security Alarm with Spring Blades | No | No | Yes | Low | No |
| Static Sensor Security Alarm | Yes | No | Yes | High | No |
| Security Alarm with Magnetic Switch | Yes | No | Yes | High | Yes |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A security alarm with a wired remote triggering device comprising:

a security alarm with alarm circuitry inside;

a wired remote triggering device connected to said security alarm for activating or deactivating said alarm circuitry and being set up from outside of a door or a drawer to keep said security alarm in an armed status, said wired remote triggering device having a triggering switch disposed on one end of a wire, said triggering switch having two spring blades so that by releasing or contacting of said two spring blades, said alarm circuitry of said security alarm is triggered or not; and a flexible sleeve tube into which both of the spring blades are removably inserted, said spring blades along with said flexible sleeve tube are clipped in a gap between a door and its doorframe or a desk and its drawer, then said flexible sleeve tube is pulled off from outside of a door or a drawer to set up said security alarm.

2. The security alarm with a wired remote triggering device of claim 1, wherein the rear end of said flexible sleeve tube is attached to a grip.

3. The security alarm with a wired remote triggering device of claim 1, wherein the flexible sleeve tube has a cylindrical portion into which the spring blades are inserted.

4. The security alarm with a wired remote triggering device of claim 3, wherein the flexible sleeve tube further has a grip adjacent to the cylindrical portion, the grip and cylindrical portion being longitudinally aligned.

5. The security alarm with a wired remote triggering device of claim 4, wherein the flexible sleeve tube is made of PVC or other polymer resins.

6. The security alarm with a wired remote triggering device of claim 1, wherein the flexible sleeve tube is made of PVC or other polymer resins.

7. The security alarm with a wired remote triggering device of claim 1, wherein the flexible sleeve tube has a grip adjacent to the cylindrical portion, the grip being exposed on an outside of the door or desk when closed and being removable whereafter the triggering switch is armed.

8. The security alarm with a wired remote triggering device of claim 7, wherein the flexible sleeve tube is made of PVC or other polymer resins.

* * * * *